United States Patent [19]

Karlotski et al.

[11] Patent Number: 4,942,330

[45] Date of Patent: Jul. 17, 1990

[54] LAMP ASSEMBLY UTILIZING SHIELD AND CERAMIC FIBER MESH FOR CONTAINMENT

[75] Inventors: Robert J. Karlotski, Weare, N.H.; Thomas J. Sentementes, Wakefield, Mass.; Roger A. Johnson, Grafton, N.H.

[73] Assignee: GTE Products Corporation, Danvers, Mass.

[21] Appl. No.: 252,090

[22] Filed: Sep. 30, 1988

[51] Int. Cl.[5] ..... H01J 61/34

[52] U.S. Cl. ..... 313/25; 313/579

[58] Field of Search .... 362/185, 377, 186 (U.S. only); 313/25, 580, 579

[56] References Cited

U.S. PATENT DOCUMENTS

| | | | |
|---|---|---|---|
| 314,208 | 3/1885 | White . | |
| 765,568 | 7/1904 | Eisenmann | 362/377 |
| 781,391 | 1/1905 | Blake | 362/377 |
| 3,300,637 | 1/1967 | Martland | 362/377 |
| 3,484,637 | 12/1969 | Van Boort et al. | 313/25 |
| 3,798,485 | 3/1974 | Witting | 313/205 |
| 4,281,274 | 7/1981 | Bechard et al. | 315/49 |
| 4,580,989 | 4/1986 | Fohl et al. | 445/26 |
| 4,598,225 | 7/1986 | Gagnon | 313/17 |
| 4,625,140 | 11/1986 | Gagnon | 313/25 |
| 4,721,876 | 1/1988 | White et al. | 313/25 |
| 4,834,266 | 6/1989 | Szántó et al. | 313/25 |

*Primary Examiner*—Palmer C. DeMeo

*Attorney, Agent, or Firm*—Wolf, Greenfield & Sacks

[57] ABSTRACT

A double-enveloped lamp assembly includes a light-source capsule subject to burst on rare occasions, a light-transmissive shield substantially surrounding the light-source capsule for absorbing and dissipating a portion of the energy when the light-source capsule bursts, a mesh of substantially nonconducting fiber for reinforcing the shield, and a light-transmissive outer envelope. The mesh is fabricated of ceramic fibers having sufficient strength to reinforce the shield. Since the fibers are nonconducting, sodium migration is minimized. The ceramic fiber mesh is particularly useful for high wattage lamps where thick-walled outer envelopes are not practical.

18 Claims, 2 Drawing Sheets

LAMP ASSEMBLY UTILIZING SHIELD AND CERAMIC FIBER MESH FOR CONTAINMENT

FIELD OF THE INVENTION

This invention relates to electric lamps and, more particularly, to double-enveloped lamps which can be safely operated without the need for enclosing the lamp within a protective fixture even in the event of a burst of the inner light source capsule.

BACKGROUND OF THE INVENTION

Electric lamps known as double-enveloped lamps include a light-source capsule, such as an arc tube, and an outer envelope surrounding the light source capsule. In such double enveloped lamps, there is a small probability that the light source capsule will burst. When such an event occurs, hot fragments of glass, or shards, and other capsule parts emanating from the burst capsule are forcibly propelled against the outer envelope. If the outer envelope also shatters, there is a potential safety hazard to persons or property in the immediate surroundings. Failure of the outer envelope is known as a "containment failure".

One way to avoid the safety hazard of containment failure is to operate the lamp within a protective fixture that is capable of containing such a failure. However, a protective fixture usually incurs additional cost, particularly if an existing fixture must be modified or replaced. Furthermore, a protective fixture reduces the light output of the lamp, and it may be more difficult and expensive to replace a lamp in a protective fixture.

A preferred solution to the containment failure problem is a lamp capable of self-containment. One known technique is to make the outer envelope stronger so that it contains the shattered light-source capsule. An outer envelope having a thick outer wall, in combination with a light-source capsule with a thin inner wall is disclosed in U.S. Pat. No. 4,598,225 issued July 1, 1986 to Gagnon. Another prior art technique is to shield the outer envelope from the effects of a burst light-source capsule. In U.S. Pat. No. 4,580,989 issued Apr. 8, 1986 to Fohl, et al, a light-transmissive enclosure located within an outer envelope surrounds a light source capsule and shields the outer envelope. See also U.S. Pat. No. 4,281,274 issued July 28, 1981 to Bechard, et al. Still another technique for containment is to reinforce the outer envelope or the shield. In U.S. Pat. No. 4,721,876 issued Jan. 26, 1988 to White, et al, a light transmissive shield is reinforced by a wire mesh. Wire mesh reinforcement of a light-source capsule is disclosed in U.S. Pat. No. 4,625,140 issued Nov. 25, 1986 to Gagnon. Containment techniques are also disclosed in pending application Ser. No. 90,983 filed Aug. 28, 1987, now abandoned, and assigned to the assignee of the present application.

While the above-referenced containment techniques are highly effective for some lamp types and sizes, they may have disadvantages when applied to other lamp types and sizes. For example, the use of a thick-walled outer envelope is effective for relatively small lamps. However, lamps of greater than 400 watts having a thick-walled outer envelope are so heavy that there is a possibility of the lamp falling out of the light fixture. Furthermore, thick-walled outer envelopes of large physical size are difficult to fabricate. While wire mesh reinforcement of a light transmissive shield is generally effective in achieving containment, the wire mesh absorbs an appreciable fraction of the output light from the light-source capsule. Furthermore, when the light-source capsule contains sodium, the proximity of a conductive wire mesh causes an effect known as sodium migration from the capsule and reduces the operating life of the lamp.

It is a general object of the present invention to provide improved double-enveloped lamps.

It is another object of the present invention to provide double enveloped lamps which can be safely operated without a protective fixture.

It is a further object of the present invention to provide double-enveloped lamps having an operating wattage greater than 400 watts wherein an outer envelope of standard thickness will contain a burst of the light source capsule.

It is still another object of the present invention to provide self-containing double enveloped lamps which have a high luminous output.

It is a further object of the present invention to provide double enveloped lamps wherein sodium migration is minimized.

It is yet another object of the present invention to provide double-enveloped lamps having a light transmissive shield reinforced with a nonconducting fiber mesh.

It is still another object of the present invention to provide double-enveloped lamps having a combination of the above features.

SUMMARY OF THE INVENTION

According to the present invention, these and other objects and advantages are achieved in a double-enveloped lamp assembly comprising a light-source capsule subject to burst on rare occasions, a light transmissive shield substantially surrounding the light source capsule for absorbing and dissipating a portion of the enery when the light source capsule bursts, a mesh of substantially nonconducting fiber for reinforcing the shield, and a light transmissive outer envelope. The light-source capsule, the light transmissive shield and the mesh are mounted within the outer envelope. The light-source capsule is typically an arc discharge tube or a tungsten halogen incandescent capsule.

The mesh of nonconducting fibers reinforces the light-transmissive shield without significantly reducing the light output from the light-source capsule. Since the mesh is nonconducting, sodium migration is minimized. In a preferred embodiment, the shield has a cylindrical outer surface and the mesh comprises nonconducting fibers wound in opposite directions around the cylindrical surface to form a double helix or double spiral. The mesh can also have the form of a net of interconnected fibers or a net of intersecting, interwoven fibers. Preferably, the mesh is located on the outer surface of the shield and is anchored to the shield at each end. The spacing between adjacent fibers in the mesh is preferably in the range between about 12 mm and 18 mm in the case of a double helix and in the range between about 4 mm and 12 mm in the case of a net.

The mesh can be fabricated of any ceramic fiber capable of withstanding the operating temperature of the light source capsule and having sufficient strength to provide effective containment. The ceramic fiber is preferably selected to minimize absorption of the light output from the light source capsule. A highly-reflecting, white or nearly white fiber is suitable. Also, a transparent or translucent fiber can be utilized.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

Figure 1:
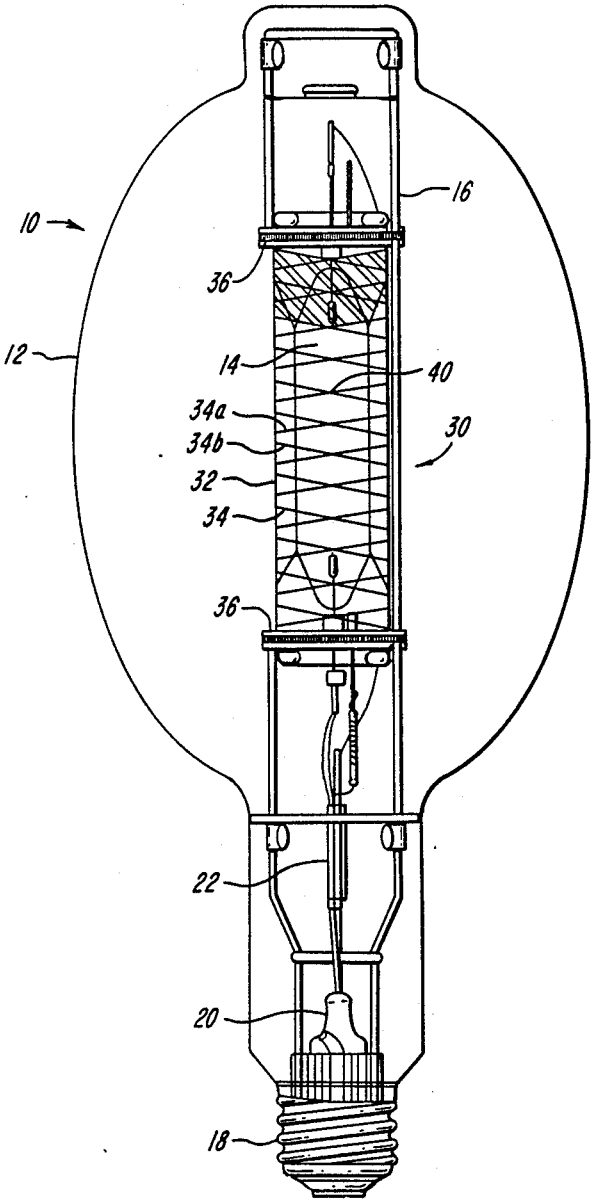
FIG. 1 is an elevational view of an arc discharge lamp constructed in accordance with the present invention.

A double-enveloped lamp assembly 10 in accordance with the present invention is shown in FIG. 1. The lamp assembly 10 includes an outer envelope 12 and a light-source capsule 14 mounted within outer envelope 12 by means of a frame 16. Electrical energy is coupled to light-source capsule 14 through a base 18, a stem 20 and electrical leads 22. Outer envelope 12 is typically formed from blow-molded hard glass. The light source capsule 14 can be an arc tube of an arc discharge lamp, a tungsten-halogen incandescent capsule or any other light emitting capsule having an internal operating pressure that differs from the operating pressure within the outer envelope 12. When such a light source capsule operates within outer envelope 12, the possibility of a lamp containment failure exists.

In accordance with the present invention, the lamp assembly 10 includes a containment means 30, located within outer envelope 12 and substantially surrounding the light-source capsule 14. The containment means 30 includes a light transmissive shield 32 and a mesh 34 of substantially nonconducting ceramic fibers. The shield 32 is typically a right circular cylinder attached to frame 16 by metal straps 36. The shield 32 is preferably fabricated of quartz. Details regarding the mesh 34 are provided hereinafter.

In one example of the present invention, the lamp assembly 10 is a metal halide arc discharge lamp having a hermetically sealed outer envelope 12. The outer envelope 12 has a longitudinal axis and the light-source capsule 14 is a metal halide arc tube having a substantially cylindrical body about the longitudinal axis. The body of the arc tube encloses an interior containing a gaseous fill and a metal halide additive. A gas fill, typically 400 torr of nitrogen, is enclosed within the outer envelope 12. The arc tube body has an outer radius, r. The shield 32 is a substantially cylindrical light transmissive enclosure mounted within the outer envelope 12 and surrounding the arc tube 14. The shield has an inner radius, R. The ratio r/R should be greater than approximately 0.54 and less than approximately 0.68 with a preferable range of approximately 0.60 to approximately 0.63. Lamp assemblies constructed in accordance with this requirement exhibit what is believed to be optimum balancing between heat conservation and radiant heat redistribution over a wide range of rated wattages such that lamp performance is substantially improved.

In the lamp assembly 10 shown in FIG. 1 and described hereinabove, containment is achieved when the outer envelope 12 has a standard minimum wall thickness of 0.46 mm. The shield 32 is preferably in the range of 1–2 mm in thickness. Preferably, the shield 32 is electrically floating, that is, not connected to the electrical power source or to ground.

The mesh 34 reinforces the light transmissive shield 32, while obviating the disadvantages of the prior art. When a burst of the light source capsule 14 occurs, shards of the shield 32 and shards of the light-source capsule 14 are substantially prevented from colliding with and shattering the outer envelope 14. The mesh 34 is formed of ceramic fibers that are substantially electrically nonconducting and that are capable of withstanding the operating temperatures of the lamp assembly 10. Since the mesh 34 is electrically nonconducting, the problem of sodium migration, to the extent that it is caused by the presence of the mesh, is eliminated. The ceramic fiber mesh has been found to have a very minor effect on lumen output from the lamp assembly 10.

The mesh 34 can have any convenient configuration that substantially surrounds and reinforces the light source capsule 14. As used in connection with mesh 34, the term "surrounds" refers to the mesh as a whole, there being apertures between the fibers that constitute the mesh. The mesh is formed of one or more fiber elements that intersect to form a net-like structure. In one preferred embodiment shown in FIG. 1, the mesh 34 comprises a double spiral, or double helix, configuration including a first ceramic fiber **34*a* helically wound around shield 32 in a one direction and a second ceramic fiber 34*b* helically wound around the shield 32 in the opposite direction. The fibers 34*a* and 34*b* are anchored at the ends of the shield 32 by straps 36. Since the fibers 34*a*, 34*b* are wound in opposite directions, they intersect at multiple points 40 and form a net-like mesh structure on the outer surface of shield 32. It will be understood that the fibers 34*a* and 34*b* can be separate fibers or a single continuous fiber. In the double helix structure shown in FIG. 1**, the spacing between turns is preferably in the range between about 12 mm and 18 mm. If the spacing between turns is small, a significant portion of the light output is blocked. Conversely, if the spacing between turns is large, the reinforcement function is diminished.

Figure 2:
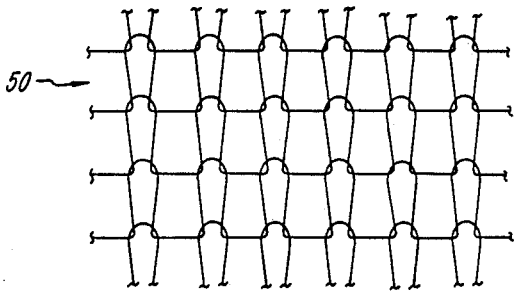
FIG. 2 is an enlarged, partial view of another embodiment of the mesh.
Figure 3:
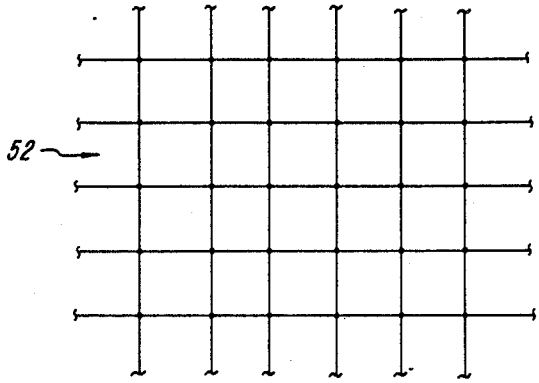
FIG. 3 is an enlarged, partial view of yet another embodiment of the mesh

Other suitable mesh structures are illustrated in Figs. 2 and 3. A woven mesh 50 comprised of ceramic fibers is illustrated in FIG. 2. In the mesh structure 52 of FIG. 3, the fibers are interconnected at each intersection to form a more rigid structure. In the embodiments of Figs. 2 and 3, the spacing between adjacent fibers in the mesh is preferably in the range between about 4 mm and 12 mm.

In one preferred embodiment, the material utilized for the ceramic fibers of the mesh is highly reflecting, for example white or nearly white, resulting in minimal light absorption. In another embodiment, the ceramic fibers are transparent or translucent. In any case, the object is to reinforce the shield 32 while minimizing the reduction in light output due to the presence of mesh 34. To this end, the diameter of the ceramic fibers should be minimized to the extent possible while maintaining sufficient strength to reinforce the light transmissive shield 32.

Preferred materials for the ceramic fiber include metal oxide fibers such as quartz fibers and vycor fibers. One preferred fiber is an alumina-boria-silica ceramic fiber sold by 3M under the tradename Nextel. The fibers are typically in the range between about 900 denier and 1800 denier.

In a preferred embodiment, a 1000 watt metal halide arc discharge lamp includes a cylindrical quartz shield approximately 138 millimeters in length. The mesh is constructed of 1800 denier Nextel fibers. Two turns of Nextel fiber are wrapped parallel and touching at each end to fasten the fiber to the shield. Then, seven turns are wound in a spiral in both directions around the shield for a total of 18 turns. The spacing between turns of each spiral is approximately 14 millimeters. For the preferred embodiment, approximately 200 arc discharge lamps have been exploded with containment in all cases.

EXAMPLE 1

The performance advantages of using a shield around the arc tube in a 1000 watt metal halide lamp, type MP 1000, with gaseous outer envelope was proved in a test where lamps made with a quartz shield having a 43 mm outer diameter and a 40 mm inner diameter and no ceramic fiber mesh averaged 111 lumens per watt at 3530° K. The control lamps without shields averaged 104 lumens per watt and 660° K. at 100 hours.

EXAMPLE 2

Another test was made with a quartz 40×43 (40 mm inner diameter and 43 mm outer diameter) shield wrapped spirally in two directions with 700 denier Nextel thread. The spacing between turns was 15 mm. The assembly was lit in a bulb to disassociate the lubricants in the Nextel fibers. This was only partially successful and the Nextel fibers were still slightly discolored and light absorbing. Despite the discoloration and the consequent light absorption, 110 lumens per watt and 3300° K. color temperature was obtained. Five lamps of this type were exploded and four contained completely. The fifth lamp had a small hole. It was deemed that the 700 denier Nextel fiber was too weak and too loosely wrapped around the shield.

EXAMPLE 3

A group of lamps was made with a standard thickness outer envelope. Nextel fiber was wrapped spirally up a 40×43 quartz shield ten turns in approximately 140 mm of length and was reverse spiral wrapped ten turns in the opposite direction. The shields and the Nextel fiber wrap were secured at both ends and were subjected to a 700° C, ten minute air firing to remove sizing contaminants. The shields were then made into lamps with explodable arc tubes. The arc tubes were purposely exploded and eight of eight lamps contained.

EXAMPLE 4

Lamps made with ten turns in each direction of 600 denier Nextel fiber treated by a 700° C., ten minute air firing yielded a luminous efficiency of 105 lumens per watt and a color temperature of 3600° K.

EXAMPLE 5

A group of lamps was made, similar to those described in Example 3, but with 600 denier Nextel fibers. Four lamps were exploded and all four contained.

EXAMPLE 6

A group of lamps was fabricated with a woven Nextel mesh with spacing between elements ranging from six squares per inch to two squares per inch. All lamps that exploded contained.

EXAMPLE 7

Lamps were made with six squares per inch mesh of 1800 denier Nextel fiber placed on a 40×43 quartz shield. These lamps yielded only 87 lumens per watt at approximately 3300° K. The relatively low lumens per watt is believed to have resulted from distortion of the mesh, causing it to be a tighter mesh than specified. The mesh became essentially a sheet of Nextel fabric and caused excessive light blockage.

EXAMPLE 8

Lamps were constructed with two different Nextel fiber diameters: 900 denier and 1800 denier. In each case the lamp was a 1000 watt metal halide lamp. Lamps having 12, 16 and 32 turns of fiber were tested. The following data is for 5 lamps in each group.

TABLE 1

| 900 Denier | | | |
|---|---|---|---|
| No. of turns | Voltage | Lumens per watt | Color Temperature °K. |
| 32 | 262 | 102.6 | 3272 |
| 16 | 260 | 106.3 | 3391 |
| 12 | 260 | 105 | 3660 |

TABLE 2

| 1800 Denier | | | |
|---|---|---|---|
| No. of turns | Voltage | Lumens per watt | Color Temperature °K. |
| 32 | 261 | 101.3 | 3312 |
| 16 | 263 | 105.0 | 3539 |
| 12 | 260 | 106.6 | 3370 |

Burst test results and manufacturing requirements indicate that the 1800 denier fiber is favored. As can be seen in Table 1 and Table 2, ht output is not degraded for the 1800 denier, 16 turn configuration. The brittleness of the 900 denier fiber makes manufacturing marginal and containment less effective. A mesh with more than 18 turns reduces the light output from the lamp.

The mesh 34 of ceramic fibers has been described herein primarily in connection with a cylindrical shield 32. It will be understood that the shape of the shield is not critical to the practice of the present invention. For example, the shield can be domed at one end as disclosed in FIG. 2 of the aforementioned U.S. Pat. No. 4,721,876, or can have other variations from a cylindrical shape.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A double-enveloped lamp assembly comprising:

a light-source capsule subject to burst on rare occasions;

containment means for absorbing and dissipating a portion of the energy when said light-source capsule bursts, said containment means comprising a light-transmissive shield substantially surrounding said light-source capsule and a mesh disposed on an outer surface of said shield for reinforcing said shield, said mesh being fabricated of substantially nonconducting ceramic fibers which can withstand the operating temperature of said light-source capsule over extended operating times, said ceramic fibers having sufficient strength to reinforce said shield and having a sufficiently small diameter to limit blockage of light emitted by said light-source capsule;

a light-transmissive outer envelope, said light-source capsule, said light-transmissive shield and said mesh being mounted within said outer envelope; and means for coupling electrical energy to said light-source capsule.

2. A lamp assembly as defined in claim 1 wherein said mesh comprises a net of interconnected fibers.

3. A lamp assembly as defined in claim 1 wherein said mesh comprises a net intersecting, interwoven fibers.

4. A lamp assembly as defined in claim 1 wherein said shield has a cylindrical outer surface and wherein said mesh comprises a double helix wound in opposite directions around said cylindrical surface.

5. A lamp assembly as defined in claim 1 wherein said mesh is fabricated of white or nearly white nonconducting fiber.

6. A lamp assembly as defined in claim 1 wherein said mesh is fabricated of transparent or translucent nonconducting fiber.

7. A lamp assembly as defined in claim 1 wherein said mesh is fabricated of highly reflecting, nonconducting fiber.

8. A lamp assembly as defined in claim 1 wherein said mesh is fabricated of nonconducting fiber in the range between about 900 denier and 1800 denier.

9. A lamp assembly as defined in claim 1 wherein said mesh is fabricated of nonconducting fiber having a spacing between adjacent fibers in the range between 4 mm and 18 mm.

10. A lamp assembly as defined in claim 4 wherein each helix has between 1.4 and 2.1 turns per inch.

11. A lamp assembly as defined in claim 1 wherein said mesh comprises a metal oxide fiber.

12. A lamp assembly as defined in claim 1 wherein said mesh comprises alumina-boria-silica fiber.

13. A lamp assembly as defined in claim 1 wherein said mesh is fabricated of a material selected from the group consisting of alumina and quartz.

14. A lamp assembly as defined in claim 1 wherein said mesh is affixed to said shield at opposite ends thereof.

15. A lamp assembly as defined in claim 1 wherein said light-source capsule has an operational wattage rating in excess of 400 watts.

16. A lamp assembly as defined in claim 1 wherein said light-source capsule contains sodium and wherein said mesh is fabricated of fiber having sufficiently low conductivity to substantially eliminate sodium migration caused by the presence of said mesh.

17. A lamp assembly as defined in claim 1 wherein said light-source capsule comprises an arc discharge tube.

18. A lamp assembly as defined in claim 1 wherein said light-source capsule comprises a tungsten halogen incandescent capsule.

* * * * *